US006544358B1

(12) United States Patent
Carr et al.

(10) Patent No.: US 6,544,358 B1
(45) Date of Patent: Apr. 8, 2003

(54) A1 ALLOY AND METHOD

(75) Inventors: Alan Robert Carr, Northants (GB); Kevin Michael Gatenby, Kingston (CA); Michael Bull, Brighton, MI (US)

(73) Assignee: Alcan International Limited, Quebec (CA)

( * ) Notice: Subject to any disclaimer, the term of this patent is extended or adjusted under 35 U.S.C. 154(b) by 0 days.

(21) Appl. No.: 09/319,005

(22) PCT Filed: Dec. 4, 1997

(86) PCT No.: PCT/GB97/03350

§ 371 (c)(1),
(2), (4) Date: Jul. 8, 1999

(87) PCT Pub. No.: WO98/24940

PCT Pub. Date: Jun. 11, 1998

(30) Foreign Application Priority Data

Dec. 4, 1996 (EP) ..... 96308783

(51) Int. Cl.[7] ..... C22C 21/06

(52) U.S. Cl. ..... 148/440; 148/692; 420/544; 420/547

(58) Field of Search ..... 420/543, 544, 420/532, 535, 534, 546, 547; 148/552, 417, 439, 440, 692

(56) References Cited

U.S. PATENT DOCUMENTS 4,093,474 A * 6/1978 Sperry et al. ..... 148/2
4,412,870 A * 11/1983 Vernam et al. ..... 148/2
4,582,541 A 4/1986 Dean et al.
5,181,969 A * 1/1993 Komatsubara et al. ..... 148/552
5,486,243 A * 1/1996 Hashiguchi et al. ..... 148/552
5,580,402 A * 12/1996 Fujita et al. ..... 148/417

FOREIGN PATENT DOCUMENTS

| | | | |
|---|---|---|---|
| DE | 3247698 C | * | 9/1986 |
| EP | 646655 A1 | | 4/1995 |
| GB | 2245591 | | 1/1992 |
| JP | 5247576 | | 9/1993 |
| JP | 5302139 | | 11/1993 |
| JP | 08-165538 A | * | 6/1996 |

OTHER PUBLICATIONS

Patent Abstracts Of Japan, vol. 018, No. 004, Abstract corresponding to Japanese Patent Publication No. 05247576 published Sep. 24, 1993, and English translation of the Publication.

Patent Abstracts Of Japan, vol. 018, No. 107, Abstract corresponding to Japanese Patent Publication No. 0532139 published Nov. 16, 1993, and English translation of the Publication.

* cited by examiner

*Primary Examiner*—George Wyszomierski
*Assistant Examiner*—Janelle Combs-Morillo
(74) *Attorney, Agent, or Firm*—Cooper & Dunham LLP

(57) ABSTRACT

An aluminium alloy in the AA5XXX series has the composition: Si 0.10–0.25 %; Fe 0.18–0.30 %; Cu up to 0.5 %; Mn 0.4–0.7 %; Mg 3.0–3.5%; Cr up to 0.2%; and Ti up to 0.1%. Rolled and annealed sheet of the alloy is readily formed into shaped components for use in vehicles which components have good strength and resistance to stress corrosion cracking.

14 Claims, 8 Drawing Sheets

A1 ALLOY AND METHOD

Figure 1:
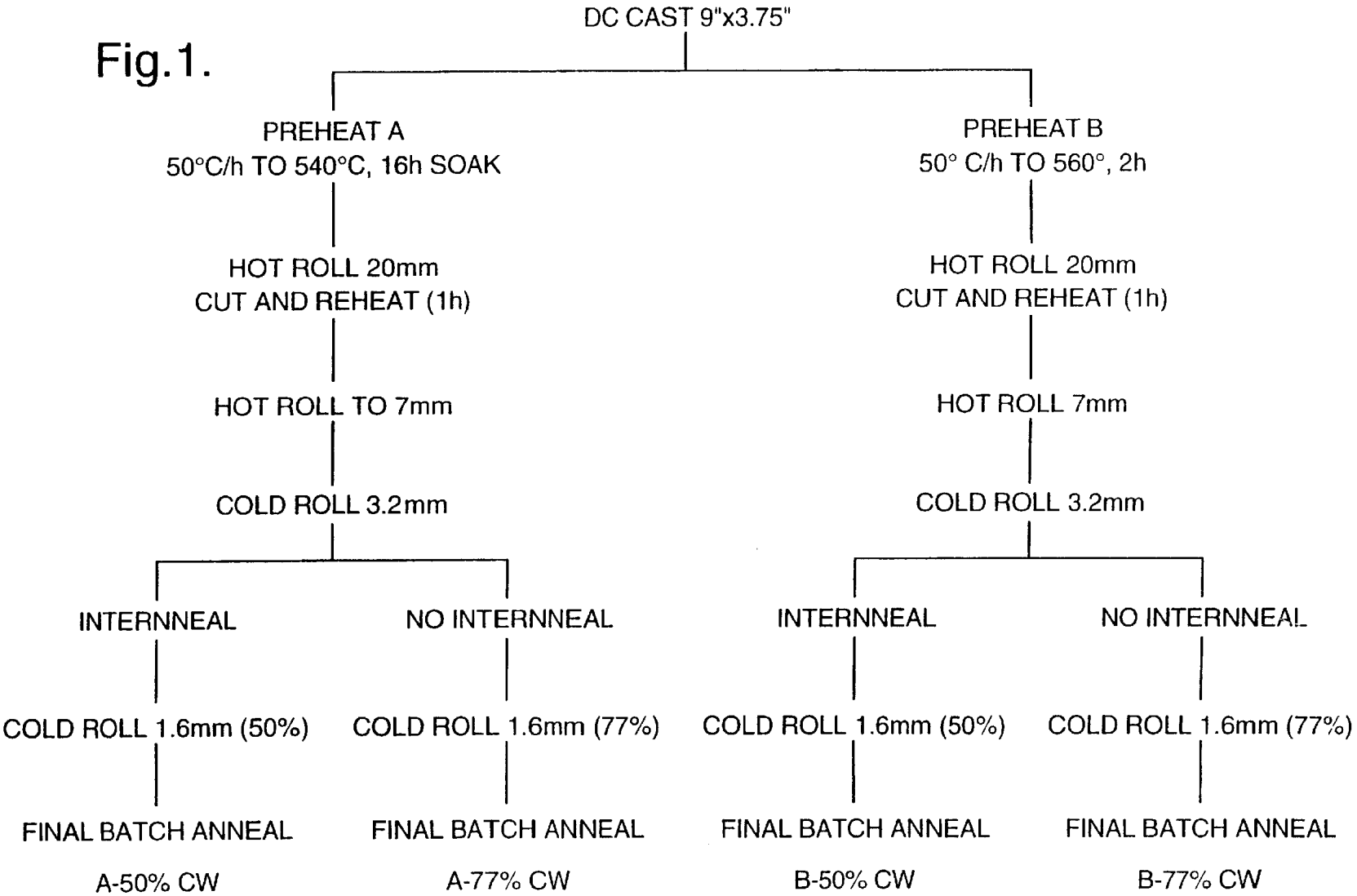

This invention is concerned with a new alloy in the 5000 Series of the Aluminum Association Register. Ingots of the alloy can be converted to rolled sheet which can be formed into shaped components for use in vehicles.

Non-heat-treatable alloys of the Al—Mg (5xxx) type are well suited to the application of automotive structural pressings to form a body-in-white structure. In the soft annealed condition (O-temper) these alloys can have high formability allowing the complex structure pressings to be manufactured. Subsequent heat treatment during the car manufacture (e.g. paint-bake ovens) reduces the as deformed strength back close to the O-Temper properties due to thermal recovery. Unlike heat-treatable alloys, these properties are then stable throughout the life of the vehicle, i.e. no artificial ageing takes place.

The alloy AA5754 is a well known non-heat-treatable 5xxx series alloy, (2.6 to 3.6% wt Mg). The specification, given in Table 1, is broad and as such far too wide for the automotive industry. The Mg level must be controlled to tighter limits to maintain an acceptable spread of proof stress values in the final sheet. Also, to render the alloy sufficiently formable, it is usually based upon low Si and Fe (about 0.08% wt Si and about 0.2% wt Fe) requiring virgin smelter metal. Such alloys are not readily recyclable because during each remelting the Si and Fe levels increase and quickly exceed the level at which formability declines. There is a need for an alloy that can be recycled. This is particularly true of alloys intended for use in the mass production of automobiles. Alloys which require smelter metal obviously are not recyclable.

TABLE 1

| AA5754 | | Si | Fe | Cu | Mn | Mg | Cr | Zn | Ti |
|---|---|---|---|---|---|---|---|---|---|
| AA 5754 | Max | 0.40 | 0.40 | 0.10 | 0.50 | 3.6 | 0.30 | 0.20 | 0.15 |
| Limits | Min | | | | | 2.6 | | | |

Conventional 5xxx series structural alloys have either lower strength, due to a reduced Mg and Mn level (such as AA5251 and AA5754), or have equivalent/greater strength but are sensitive to intergranular corrosion and Stress Corrosion Cracking (such as AA5182).

This invention relates to the development of an alloy composition and processing route which gives rise to a higher strength 5xxx series alloy which is insensitive to SCC, and tolerant to high levels of Si and Fe in terms of formability. A characteristic of the current alloy is that because it can contain high levels of Si and Fe, it is therefore more recyclable.

In one aspect the present invention provides an alloy of composition in wt %:

Si 0.10–0.25 preferably 0.10–0.20

Fe 0.18–0.30 preferably 0.20–0.30

Cu up to 0.5 preferably up to 0.3

Mn 0.4–0.7 preferably 0.4–0.5

Mg 3.0–3.5

Cr up to 0.2 preferably up to 0.1

Ti up to 0.1

Others up to 0.05 each, 0.15 total

Al balance

This is a relatively high-strength alloy, it has a 0.2% proof strength of 105–110 MPa, compared to 90–95 MPa for the standard AA5754 alloy containing 2.9 wt % Mg.

Components for load bearing structures in automobiles are press formed which involves stretch forming and deep drawing Deep drawing is often the most important process, and this calls for a high r value, that is to say a high plastic strain ratio, that is uniform in the plane of the sheet. This need is met by the alloys of the invention.

Mg is the principal solid solution strengthening addition in the alloy. The Mg content of the alloys of this invention, which is relatively high at 3.0–3.5%, results in increased strength and formability. However, if the Mg level is raised too far, then intergranular corrosion and stress corrosion cracking (SCC) problems, associated with the formation of an $Al_8Mg_5$ precipitate at grain boundaries, restrict performance. For batch annealed material, an upper limit of Mg is set at 3.3%. For continuously annealed and solution heat-treated (CASH) material, the Mg content may be pushed up as high as 3.5%.

Mn is present at relatively high levels of 0.4–0.7% preferably up to 0.6% more preferably up to 0.5%. Homogenisation of the alloy results in precipitation of $\alpha$-AlMnSiFe particles which give rise to additional dispersoid strengthening. Very high Mn levels are detrimental due to the formation of a coarse intermetallic phase $MnAl_6$. The increased density of dispersoids causes a refinement of the O temper grain size and a resultant increase in strength.

Cu may be present at levels up to 0.5% preferably up to 0.3%, more preferably up to 0.10%. At higher levels (e.g. up to 0.3%), Cu gives rise to significant strength retention after a paint bake cycle. Above 0.3% no additional benefit is obtained. Cu is an inevitable impurity in recycled scrap. Cu levels above 0.15% give rise to alloys having high r values but which may (unless the working conditions are rather closely controlled) be detrimental by virtue of very pronounced variation in the plane of the sheet (high $\Delta r$).

Si is present at 0.10–0.25% preferably up to 0.20% and improves strength. High Si and Mn have surprisingly been found to improve the r value of sheet and to promote uniformity in the plane of the sheet (low $\Delta r$). But Si content as high as 0.3% gives rise to reduced ductility and reduced formability.

Fe is specified at 0.18–0.30% preferably 0.20–0.30%. Fe contributes to dispersion strengthening, but at high concentrations lowers formability.

The Si and Fe levels are set such that the alloy can be produced from recycled metal. Recycling increases the Si and the Fe levels in the charge. It also increases the Cu content. The new alloy of the invention is more tolerant of these impurities.

Cr has similar effects to Mn and may be used in partial replacement of Mn. Preferably the (Cr+Mn) content is at least 0.4%. Preferably Cr is not deliberately added to the alloy, i.e. is present only as an incidental impurity at up to 0.05%.

Ti may be added to refine the grain structure.

Other alloying components may be present in minor concentrations up to 0.05% each, 0.15% total. Components deliberately added may include Zn and B. Other components would normally be present only as adventitious impurities. The balance of the alloy is Al.

In another aspect the invention provides rolled and annealed sheet of the alloy described. (Rolled sheet for canstock is used in a hard as-rolled condition). The following paragraphs describe the processing steps used to produce that rolled sheet.

Molten metal of the required composition is cast, typically by direct chill casting although the casting technique is not material to the invention. An ingot of the alloy is homogenised, preferably at a relatively high temperature of at least 500° C. preferably 530–5800° C. particularly 550–580° C., for 1–24 hours. Homogenisation is preferably performed under conditions that result in the formation of a fine dispersoid of α-AlMnSiFe particles. If the homogenisation temperature is too low, it is possible that this may be produced as a coarser needle-like precipitate which exhibits growth with increased homogenisation time. These needles can break up during rolling to create voiding in the structure, resulting in possible reduced ductility. Homogenisation at sufficiently high temperature results in spherical precipitates being formed which do not break up during rolling. These dispersoids are also relatively stable in size with homogenisation times up to 16 hours and possibly beyond.

The homogenised ingot is then hot rolled and cold rolled, both under conditions which may be conventional. During cold rolling, an interanneal is optional, preferably at a temperature of 300–400° C. in batch operation or at 400–550° C. in continuous operation. When an interanneal is employed, a final cold rolling treatment results in a thickness reduction preferably in the range 40–60% e.g. about 50%. A final annealing step, preferably at 300–400° C. for 0.05–5 hours in batch operation, or at 400–550° C. in continuous operation, may be carried out on a batch basis, or as a continuous anneal and solution heat treatment. Annealing conditions should be such as result in a fully recrystallised grain structure i.e. one produced by high angle grain boundaries sweeping through the structure. Such alloys have good formability and high elongation to break.

The resulting rolled sheet has the aforementioned combination of desired properties: high strength, insensitive to stress corrosion cracking and tolerant to high levels of Si and Fe in terms of formability. The sheet will be useful for forming into components to be joined together, e.g. by adhesive bonding or weld bonding or mechanical fastening to form structures e.g. load-bearing structures of motor vehicles.

The alloys used in Example 1 are set out in Table 2 below. Of these, STD is a typical M5754 standard composition; 1, 2, 3 and 4 are in accordance with the present invention.

TABLE 2

| ALLOY | Si | Fe | Cu | Mn | Mg | Cr | Zn | Ti |
|---|---|---|---|---|---|---|---|---|
| STD | 0.068 | 0.21 | 0.001 | 0.26 | 2.92 | — | — | 0.012 |
| 1 | 0.16 | 0.25 | 0.002 | 0.44 | 3.24 | — | — | 0.013 |
| 2 | 0.16 | 0.25 | 0.15 | 0.43 | 3.36 | — | — | 0.012 |
| 3 | 0.22 | 0.24 | 0.002 | 0.43 | 3.25 | — | — | 0.012 |
| 4 | 0.21 | 0.24 | 0.151 | 0.43 | 3.28 | — | — | 0.012 |

Reference is directed to the accompanying drawings in which:

FIG. 1 sets out the casting and processing schedule of the alloys described in Table 1.

Each of FIGS. 2 to 14 is a bar chart comparing a particular feature between different alloys or different processing routes.

Alloys having compositions set out in Table 2 were DC cast and processed in the Laboratory to 1.6 mm gauge sheet according to the schedule set in FIG. 1. Inter-anneals and the final batch anneal were carried out at 330° C. for 2hrs. followed by air cool. The sheets were subjected to the following tests:

i) Tensile test parameters as a function of orientation ii) Erichsen value iii) Hydraulic bulge height and thickness failure strain (logarithmic) in balanced bi-axial tension iv) Plane strain tension limit strains v) r value as a function of orientation vi) R/t bend test. (R=inner bend radius, t=material gauge)

Standard ASTM E8 tensile specimens were used to generate the standard tensile data of proof, UTS, uniform and total elongation, in the three major directions. From the data, strain hardening index values (n) were derived.

Erichsen values were obtained using the standard test procedure and geometry, with a polyethylene film used as a lubricant between the tooling and the sheet material.

The bulge height and thickness failure strains were determined using a hydraulic bulge testing machine that rigidly clamps a sheet of material using a draw bead section machined on a 175 mm pitch circle. Sheet thickness was determined after bulging of the material using an ultrasonic probe, from which the failure strain was determined.

Plane strain tension limit strains were determined by using a fixture that offered transverse restraint to the tensile specimens via the use of knife edges. (Technique reference: Sang H., Nishikawa Y., A Plane Strain Tensile Apparatus. J. Metals, 35(2), 1983, pp30–33).

The r values were determined using JIS#5 tensile specimens, (50 mm gauge length, 25 mm width), the increased width giving rise to more accurate width strains and hence r values.

R/t bend tests were carried out by bending the material according to ASTM Designation E 290 92. This apparatus was used to bend samples through approximately 150°, after which they were squeezed to a 180° bend in a vice. The outer surface of the bend was then examined for evidence of orange peel/cracking for the different radii used in the trials.

Additionally, standard ASTM E8 tensile specimens were pulled to both 2% and 5% strain, and then subjected to a standard paint bake cycle of 180° C. for 30 minutes to assess whether Cu additions up to 0.15% wt would give rise to any significant strength retention after a paint bake cycle.

Stress Corrosion Cracking, (SCC), sensitivity was assessed via slow strain rate testing, ($1\times10^{-7}$ per second). Specimens were pre-strained 20% followed by sensitisation at 150° C. for varying times, and then tested under both dry conditions and immersed in a salt/peroxide solution (3% NaCl 0.3% $H_2O_2$). The elongation to failure for each test was recorded, and plotted for individual conditions as a ratio of the wet to dry performance. A ratio of one indicates no sensitivity to SCC.

Homogenisation at 540° C. produced needle like precipitates in the cast ingot, whereas the higher temperature treatment at 560° C. resulted in the formation of a spherical precipitate. This spherical precipitate was very resistant to coarsening over homogenisation times up to 16 hours at temperature.

Figure 2:
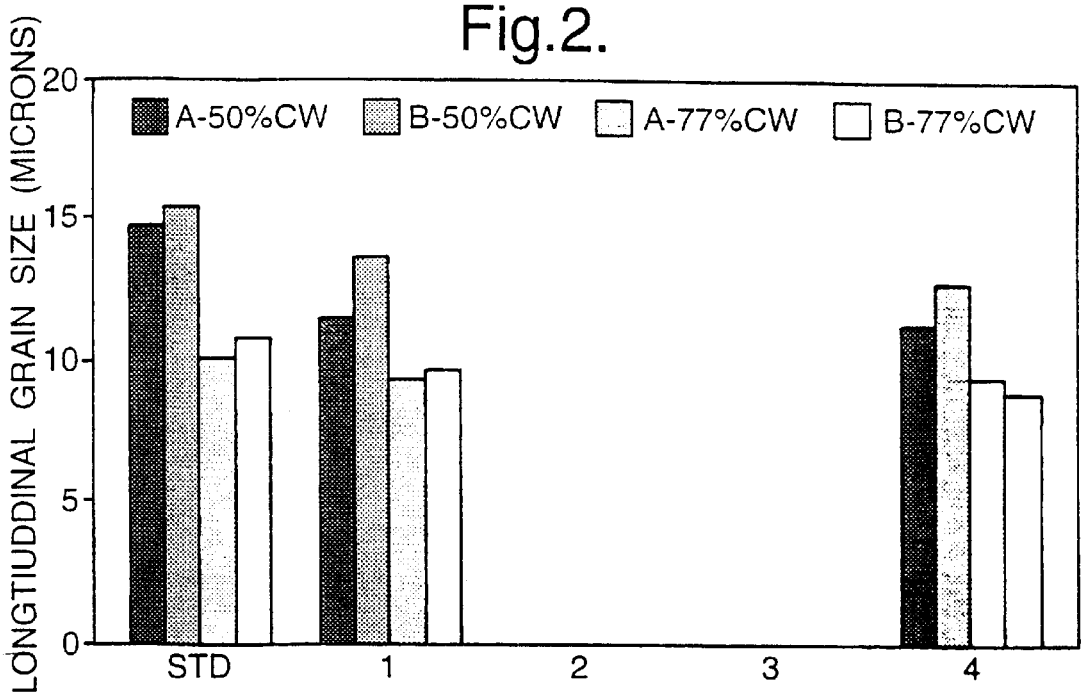

After cold rolling, the grain size of the high Cu high Si alloy 4 was finer than in the standard alloy, and the higher reduction resulted in a finer grain size. The low temperature homogenisation gave a finer grain size, (FIG. 2).

Figure 3:
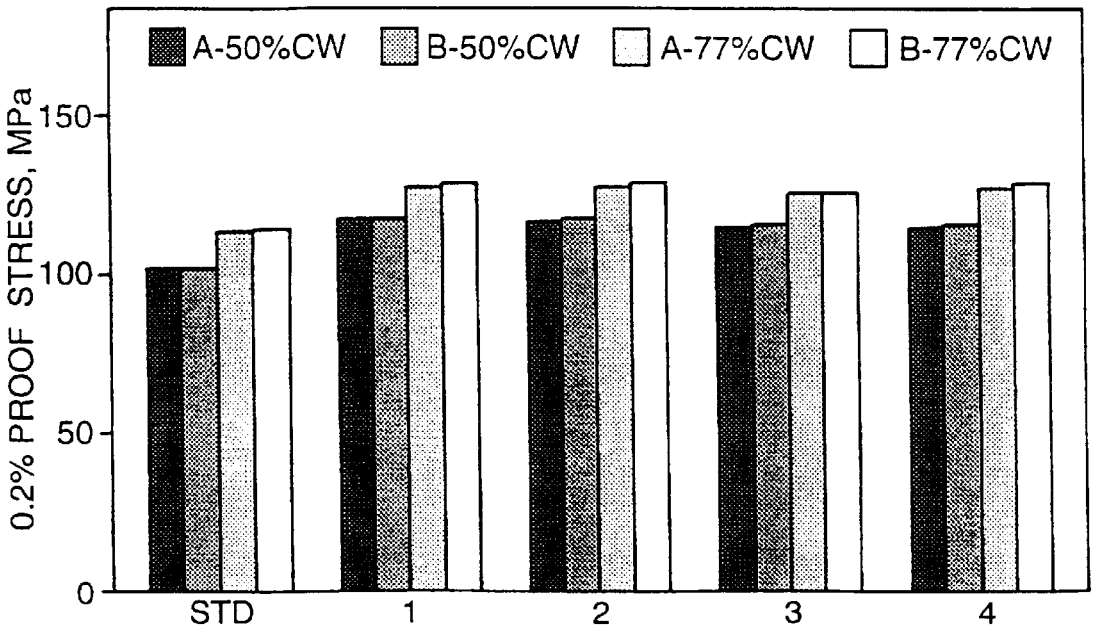
Figure 4:
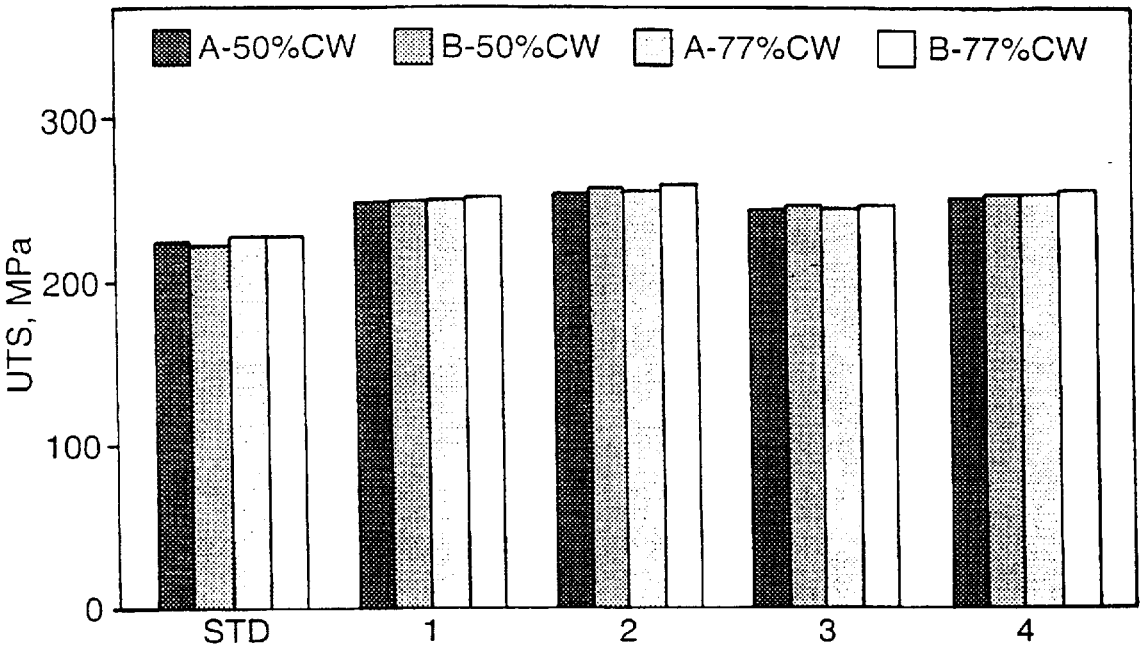
Figure 5:
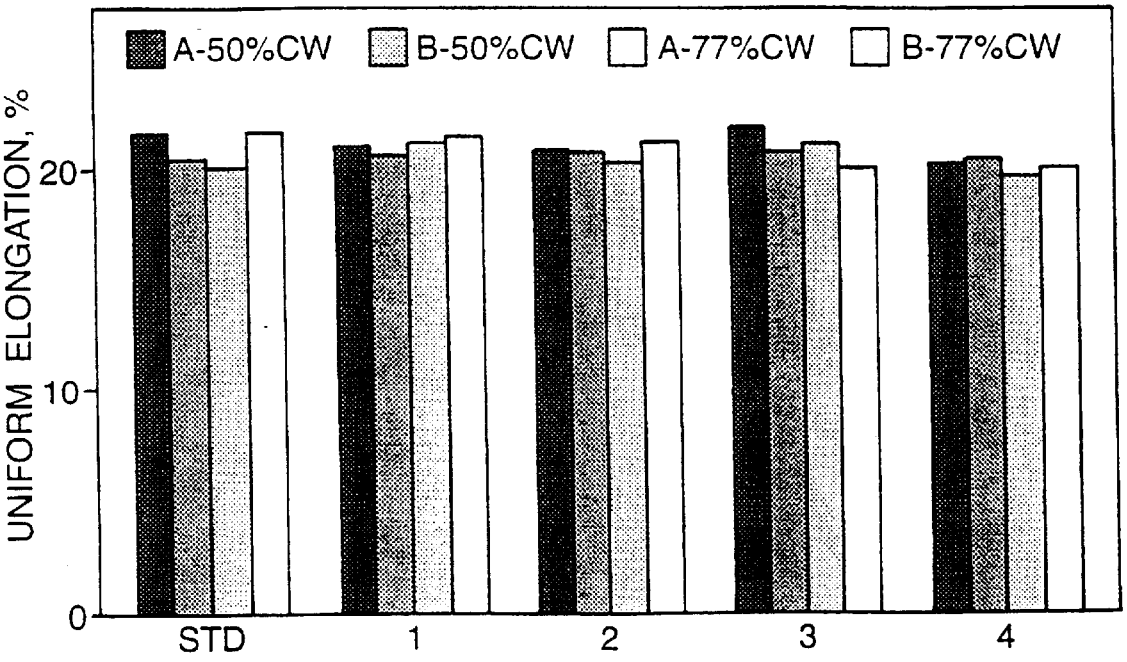
Figure 6:
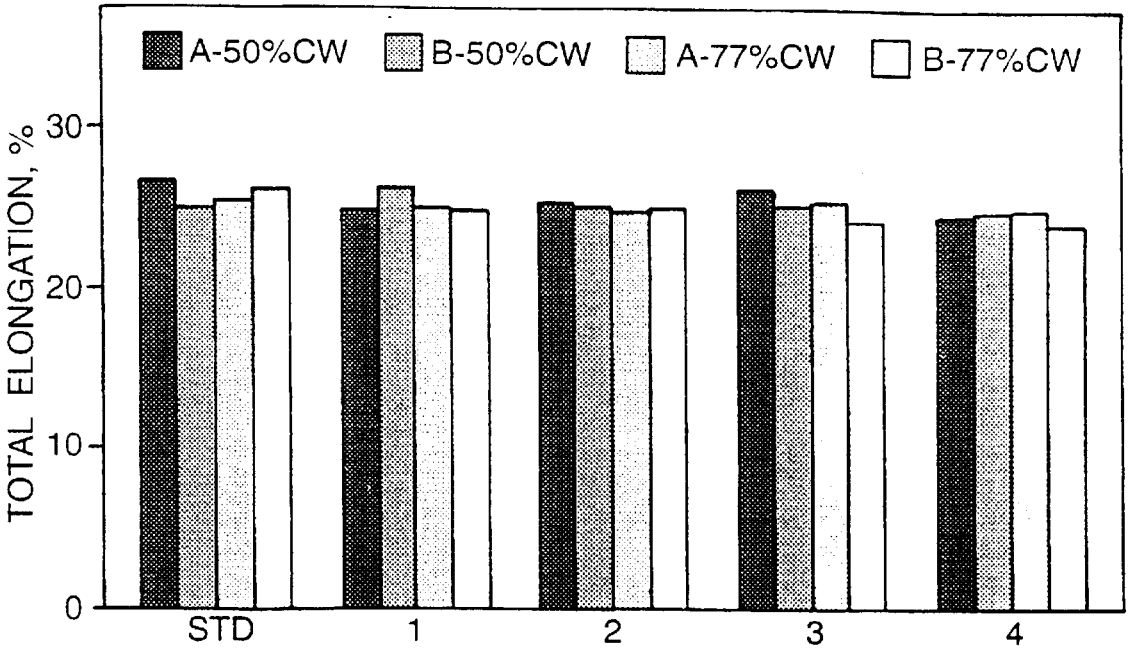

Proof and tensile strength of the alloys are compared in FIGS. 3 and 4. Comparing alloy 1 with the standard alloy STD reveals the strengthening effect of the higher levels of Mg and Mn. Also, this has been achieved with minimum reduction in formability in spite of the increased levels of Si and Fe, FIGS. 5 and 6

Figure 7:
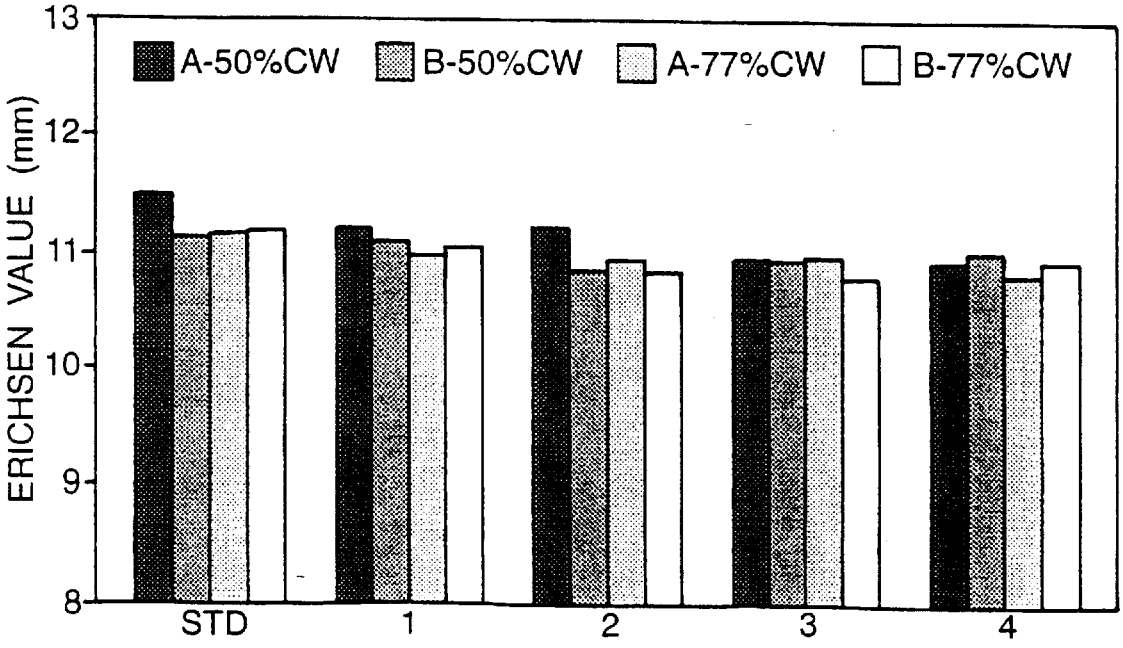

The Erichsen test data are shown in FIG. 7.

Figure 8:
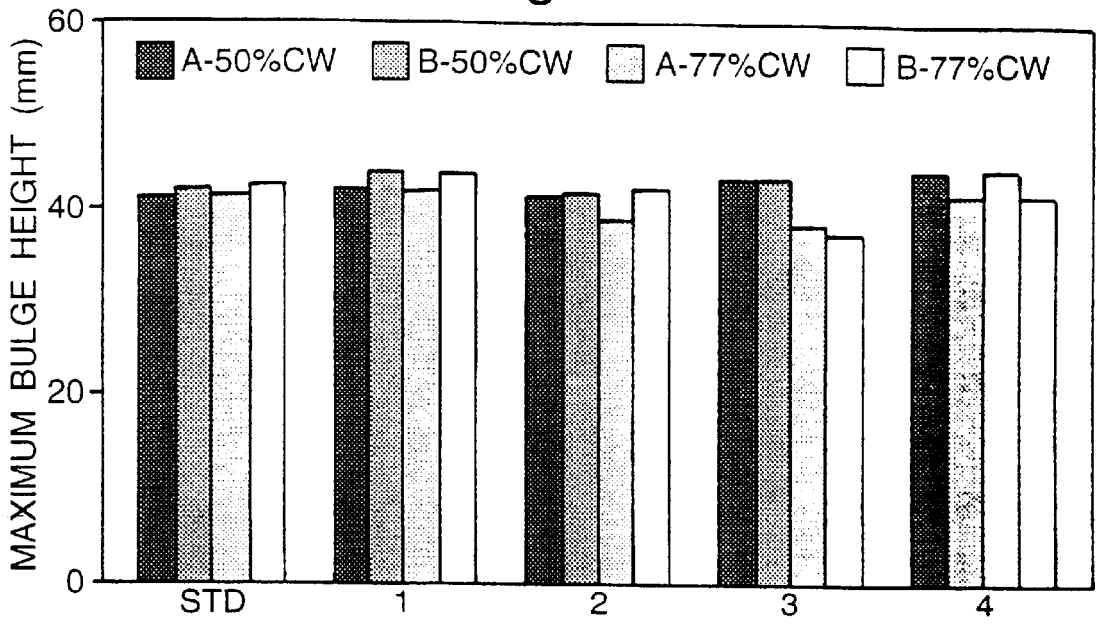
Figure 9:
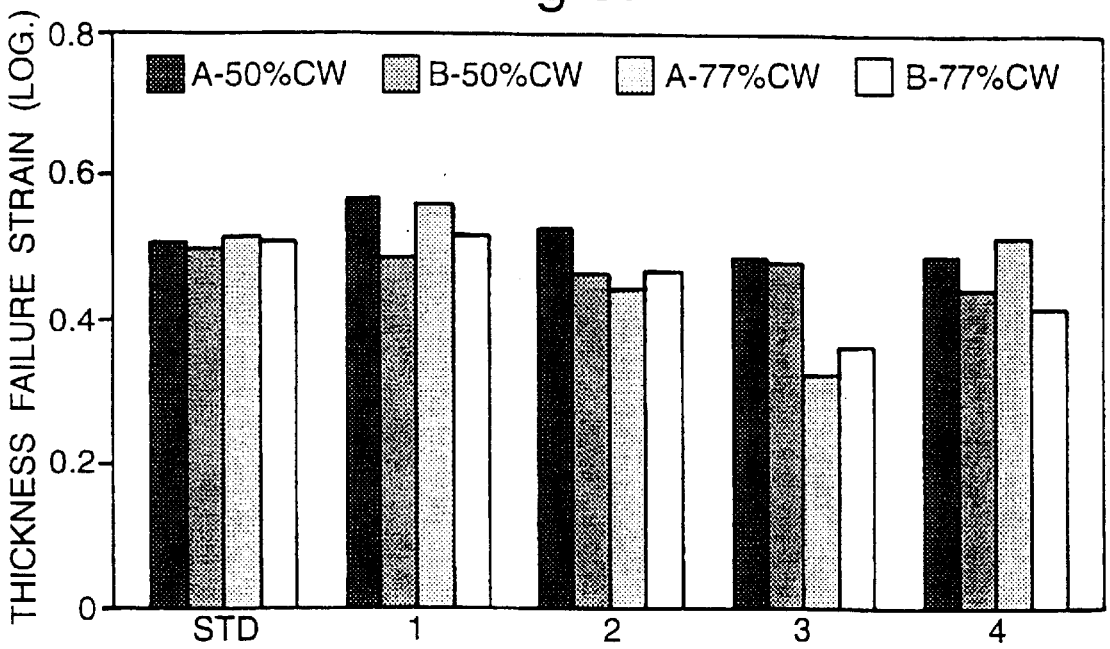

The hydraulic bulge height data, and the bulge thickness failure strain data, are shown in FIGS. 8 and 9 respectively. The properties of 1 are distinctly superior to those of 2, 3 and 4.

Figure 10:
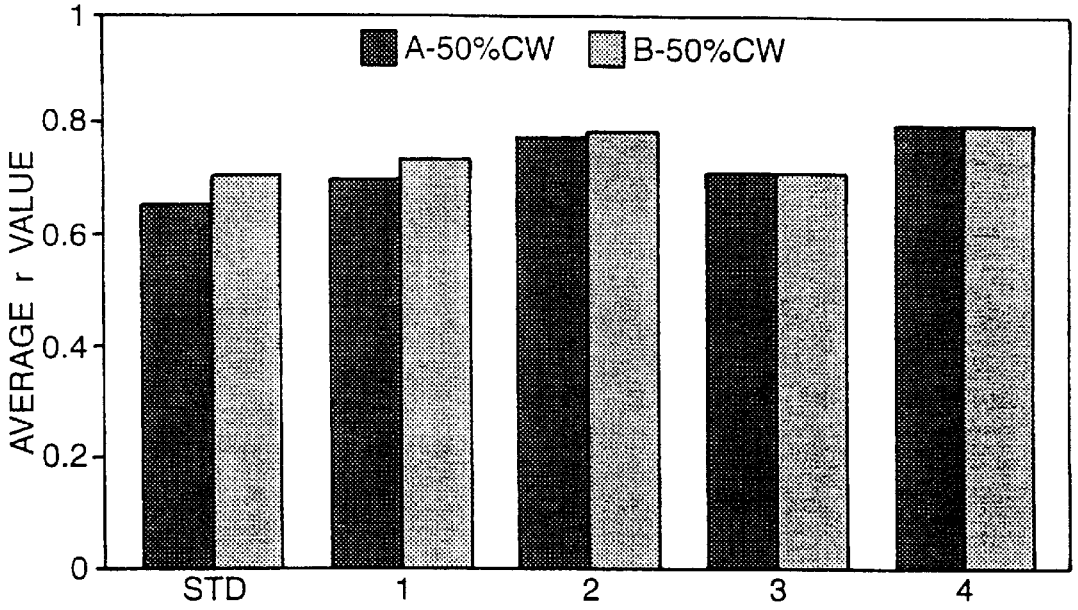
Figure 11:
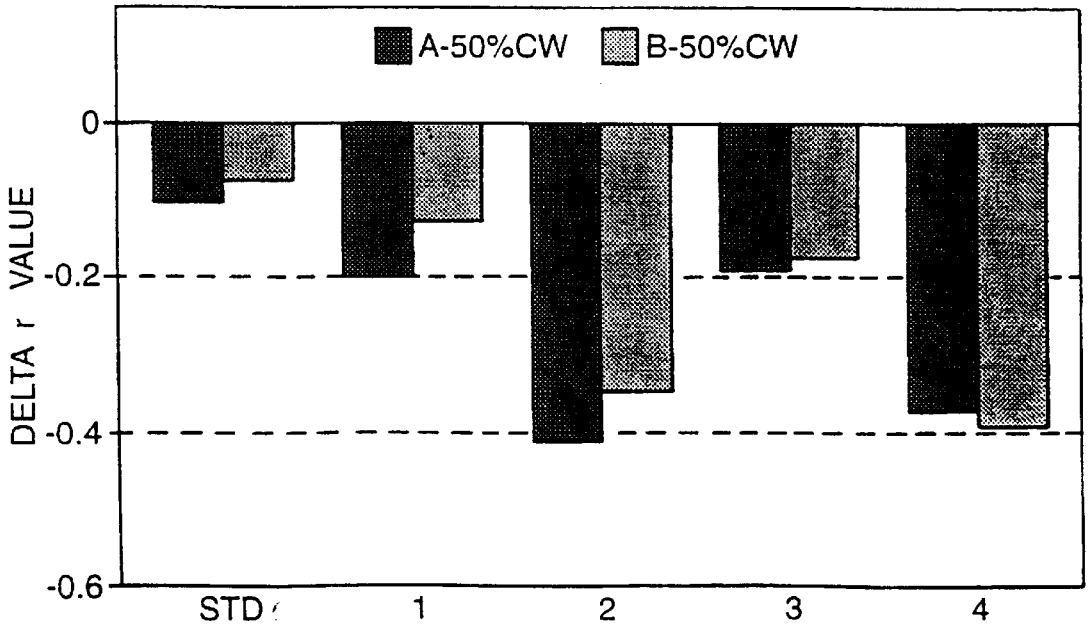

FIGS. 10 and 11 compare the r values of the sheets. 1 and 3 have the best combinations of high r value and little variation in the plane of the sheet (Δr). The Cu containing alloys had higher average r values but very pronounced variations (Δr) in the plane of the sheet.

Figure 12:
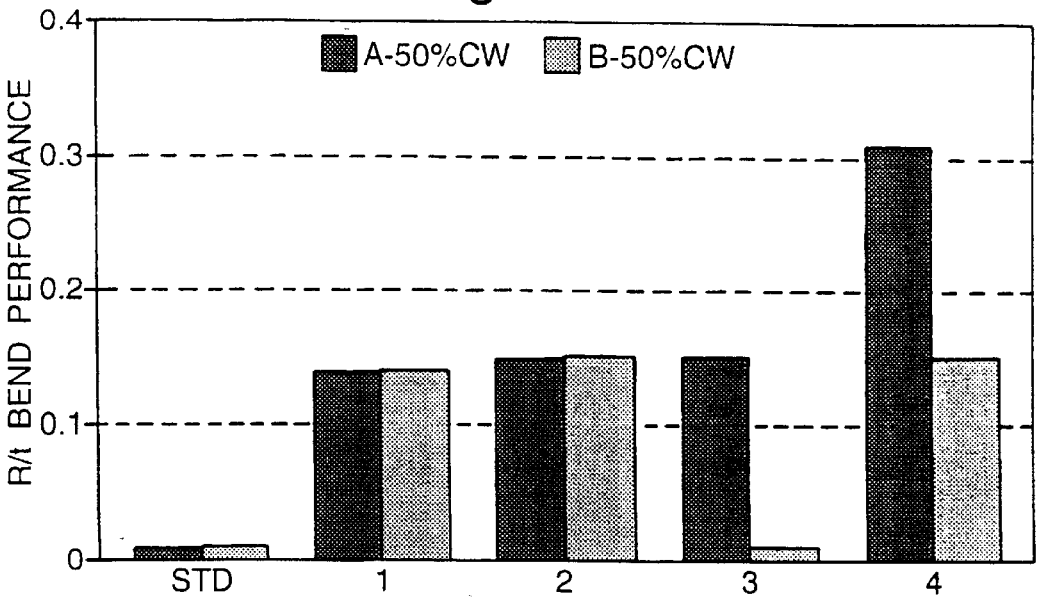
Figure 13:
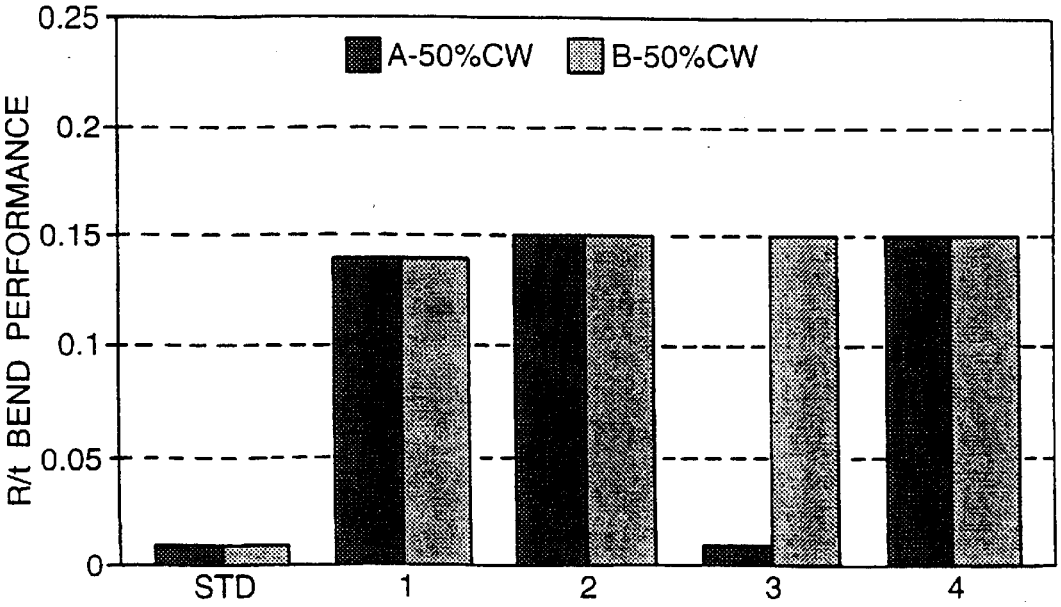

FIGS. 12 and 13 show respectively longitudinal R/t bend test data and transverse R/t bend test data.

EXAMPLE 2

Stress Corrosion Cracking Batch and Continuously Annealed Sheet

Stress corrosion cracking was measured on experimental alloys rolled and processed on a commercial mill. Stress corrosion cracking is caused by the precipitation of a continuous film of $Al_8Mg_5$ on grain boundaries and this process is substantially independent of the Si or the Mn contents of the alloy. The amount of these elements in the test alloys is therefore substantially irrelevant to the results obtained. The important element is Mg.

The composition and the process schedule for the alloys 5 and 6 are set out below:

Alloy 5. 3.49% Mg, 0.59% Mn, 0.06% Si, 0.22% Fe
6. 3.44% Mg, 0.63% Mn, 0.15% Si, 0.19% Fe

Processing Route

Batch annealing was compared with continuous anneal of alloy 5 rolled on a commercial mill according to the following schedule:

DC cast 600 mm ingot

Homogenise 550° C. for 9 hours

Hot roll to 4.2 mm (self anneal reroll)

Cold roll to 1.6 mm final gauge

Either (1) Batch anneal (BA), heating at 50° C./hr to 330° C. and soak for 2 hours or (2) Continuously anneal (CAL) at 450° C. peak metal temp and forced air cool.

An evaluation of the sensitivity to SCC was made. The comparison metals were: a commercial AA5182 alloy containing 4.5% Mg, a commercial AA5754 batch annealed alloy having a composition close to STD and alloy 1 from Example 1.

Figure 14:
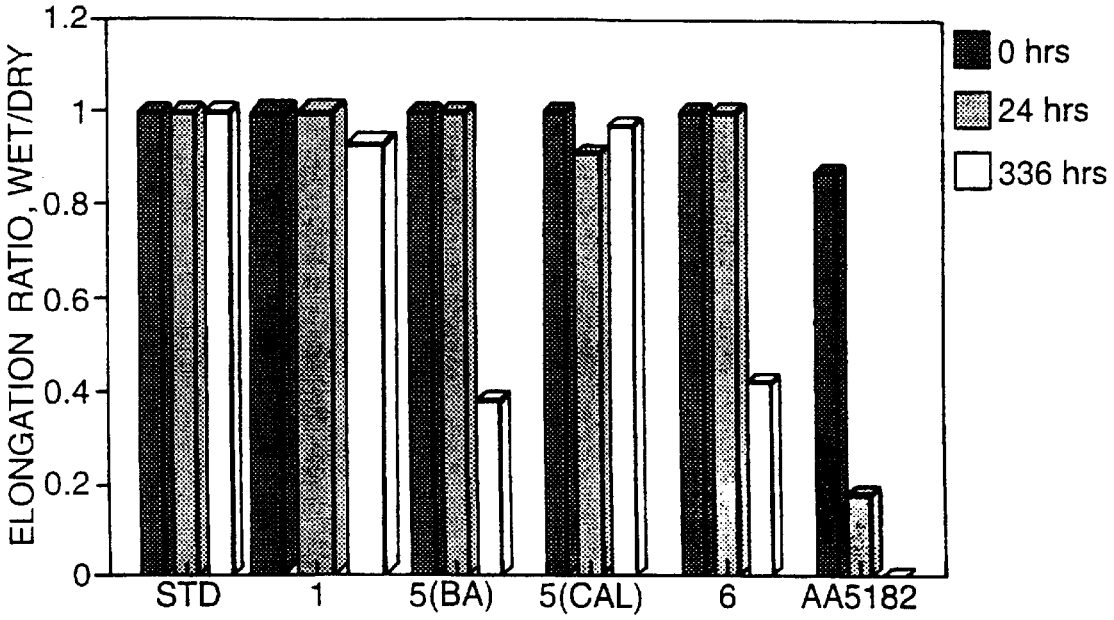

Resistance to stress corrosion cracking of these alloys after a batch anneal is shown in FIG. 14. The batch annealed 3.25% Mg alloy has good stress corrosion resistance whereas the similarly treated alloys 5 and 6 containing 3.49% and 3.44% Mg show a marked reduction in stress corrosion cracking resistance. However the continuously annealed alloy 5 showed improved stress corrosion cracking resistance, and the same would have been the case, it is believed, for a continuously annealed alloy 6.

EXAMPLE 3

Another Alloy

Al alloy 7 had the composition in wt %:

| | |
|---|---|
| Mg | 3.41 |
| Mn | 0.45 |
| Fe | 0.244 |
| Si | 0.14 |

Processing Route

Ingot preheat −540° C.

Hot rolled to 3.5 mm (re-roll gauge).

Cold rolled to 1.6 mm (final gauge).

Cold reduction 54%.

Final anneal −340° C.

| Properties | |
|---|---|
| 0.2% Yield Stress (MPa) | |
| Longitudinal | 114 |
| 45° | 109 |
| Transverse | 113 |
| Total Elongation (%) | |
| Longitudinal | 20.1 |
| 45° | 24.5 |
| Transverse | 24.1 |
| Formability (depth/height, mm) | |
| 10 cm draw | 32 |
| 20 cm plane strain | 26 |
| Biaxial | 42 |
| r/t Bend | |
| Longitudinal | 0.12 |
| Transverse | 0.06 |
| Erichsen dome height (mm) | 9.6 |

For an alloy that can be made from recycled metal, rather than smelter metal, these properties are satisfactory.

What is claimed is:

1. An alloy of composition consisting essentially of (in wt %):

| | |
|---|---|
| Si | 0.10–0.25 |
| Fe | 0.18–0.30 |
| Cu | up to 0.15 |
| Mn | 0.4–0.5 |
| Mg | 3.0–3.5 |
| Cr | up to 0.2 |
| Ti | up to 0.1 |
| Zn | up to 0.05 |
| B | up to 0.05 |
| Unavoidable impurities | up to 0.05 each, 0.15 total |
| Al | balance, |

wherein the alloy comprises recycled metal, and wherein spherical dispersoids of α-AlMnSiFe particles are present.

2. Rolled and annealed sheet of the alloy of claim 1.

3. Automobile structural components made from the sheet of claim 2.

4. A sheet as claimed in claim 2 which is insensitive to stress corrosion cracking.

5. An alloy as claimed in claim 1, comprising 0.10–0.20 wt. % Si.

6. An alloy as claimed in claim 1, comprising 0.20–0.30 wt. % Fe.

7. An alloy as claimed in claim 1, comprising up to 0.1 wt. % Cr.

8. An alloy as claimed in claim 1, wherein Si is present in an amount of 0.16–0.25 wt %.

9. An alloy as claimed in claim 1, wherein Si is present in an amount of 0.14–0.25 wt %.

10. A method of making the sheet of claim 2 comprising the steps: casting; homogenising at 550–580° C.; hot rolling; cold rolling; optional interannealing; final cold rolling; final annealing wherein the homogenisation is performed under conditions that result in the formation of spherical dispersoids of α-AlMnSiFe particles.

11. A method as claimed in claim 10, wherein:

casting is by DC casting;

optional interannealing is at 300–400° C. in batch operation or at 400–500° C. in continuous operation;

final cold rolling is to a 40–60% reduction;

final annealing is at 300–400° C. in batch operation or at 400–550° C. in continuous operation.

12. A method as claimed in claim 11, wherein the alloy contains 3.0–3.3% Mg and final annealing is performed on a batch basis.

13. A method as claimed in claim 11, wherein the alloy contains 3.2–3.5% Mg and final annealing is performed continuously.

14. A method as claimed in claim 10, wherein homogenizing is at 560–580° C.

* * * * *